US005666695A

United States Patent [19]

Jegers et al.

[11] Patent Number: 5,666,695

[45] Date of Patent: Sep. 16, 1997

[54] HINGE SYSTEM

[75] Inventors: Viktor J. Jegers, Eden Prairie; Robert G. Lau, Anoka; David A. Swan, Shoreview, all of Minn.

[73] Assignee: Federal-Hoffman, Inc., Anoka, Minn.

[21] Appl. No.: 558,412

[22] Filed: Nov. 16, 1995

Related U.S. Application Data

[63] Continuation of Ser. No. 155,123, Nov. 19, 1993, abandoned.

[51] Int. Cl.[6] ..... E05D 5/12

[52] U.S. Cl. ..... 16/381; 16/380; 16/389

[58] Field of Search ..... 16/381, 380, 386, 16/387, 342, 389

[56] References Cited

U.S. PATENT DOCUMENTS

| | | | |
|---|---|---|---|
| 93,058 | 7/1869 | Cole . | |
| 713,338 | 11/1902 | Paquette . | |
| 1,728,433 | 9/1929 | Mohun . | |
| 1,754,013 | 4/1930 | Fisher | 16/380 |
| 1,824,886 | 9/1931 | Hart . | |
| 1,979,894 | 11/1934 | Lyons . | |
| 2,817,871 | 12/1957 | Ferry . | |
| 2,937,399 | 5/1960 | De Vore . | |
| 2,997,734 | 8/1961 | Dyer | 16/381 |
| 3,013,297 | 12/1961 | Ferry . | |
| 3,068,508 | 12/1962 | Heyer | 16/386 |
| 3,135,013 | 6/1964 | Parsons . | |
| 3,621,512 | 11/1971 | Johnson | 16/380 |
| 3,733,649 | 5/1973 | Nagy et al. . | |
| 3,865,051 | 2/1975 | Johl et al. | 16/389 |
| 3,962,750 | 6/1976 | Buss et al. | 16/381 |
| 4,413,449 | 11/1983 | Faye | 16/389 |
| 4,455,711 | 6/1984 | Anderson . | |
| 4,475,266 | 10/1984 | Suska | 16/380 |
| 4,603,452 | 8/1986 | Paciorek . | |
| 5,355,559 | 10/1994 | Bowers et al. | 16/389 |

FOREIGN PATENT DOCUMENTS

| | | |
|---|---|---|
| 716946 | 10/1931 | France . |
| 33 14 753 | 10/1984 | Germany . |
| 26 23 140 | 8/1988 | Germany . |
| 278783 | 11/1964 | Netherlands . |

*Primary Examiner*—Chuck Y. Mah

*Attorney, Agent, or Firm*—Merchant, Gould, Smith, Edell, Welter & Schmidt, P.A.

[57] ABSTRACT

A hinge includes a first leaf member with a pair of knuckles receiving a hinge pin therethrough. The knuckles include a retainer member which extends into the path of the pin. Annular grooves formed in the pin receive the retainer member to keep the pin from easily sliding in and out of the hinge. One of the grooves includes a straight side and a tapered side while the second groove includes a pair of tapered sides for allowing the retainer member to slide over the second groove but not over the first groove. In this manner, the pin may not be forced beyond the retainer member and is held in place even when pulled out of the first knuckle for removing secondly.

7 Claims, 4 Drawing Sheets

HINGE SYSTEM

This is a continuation of application Ser. No. 08/155,123, filed Nov. 19, 1993 now abandoned.

BACKGROUND OF THE INVENTION

1. Field of the Invention

The present invention relates to a hinge, and in particular to a self retaining hinge having a single piece hinge leaf.

2. Description of the Prior Art

Hinges having a hinge body and a pin inserting therein are well known. Hinges having a pin retaining feature provide advantages as the pin may be removed for several reasons, such as to remove a leaf, or to remove a cover or door. However, when the pin is removed, it may be easily misplaced or lost. Therefore, it is advantageous to provide a hinge which allows the pin to be slid out from the hinge body to allow separation of the two portions pivoting about the hinge, but still retains the pin.

Attempts to prevent inadvertently removal of a pin are shown in U.S. Pat. 1,979,894 to Hart. However, the hinge does not hold the pin in position once it is removed from the retaining position. In addition, the hinge requires additional elements other than the hinge body for retaining the pin. U.S. Pat. 2,817,871 to Ferry also shows a hinge with pin retaining properties, but does not provide for retaining the pin a position to release one of the leaves. The hinge does not provide for reversing the pin and still have a retaining feature function in a proper manner.

It can be seen then that an improved hinge is needed which provides for retaining the pin when it is fully assembled or when the two leaves are separated. Such a hinge should also provide for providing flexible assembly so that the pin may be reversed while properly retaining the pin. The present invention addresses these and other problems associated with hinges.

SUMMARY OF THE INVENTION

The present invention is directed to a hinge which provides for removing a pin from a retaining position for separation while retaining the pin. A hinge includes a main body portion and a leaf portion which are connected with a removable pin. The pin is retained by knuckles on the main body portion and the leaf portion. The hinge main body portion includes a pair of knuckles which have retaining members formed therein. The retaining members are biased toward the pin and engage annular grooves formed in the pin. The pin has a first groove which has tapering sides and a second groove which has one straight side and one tapered side. With this configuration, the pin may be inserted in a first direction and slid with the retaining portion sliding over the tapered sides. However, when the retaining member engages the straight side of the second groove, the straight side abuts the member and cannot be slid further.

When the pin is pulled out from the engaged position, the leaf member may be separated from the main body portion of the hinge. However, the retaining member of the second knuckle biases against the groove and retains the pin within one of the knuckles. Therefore, the pin is not misplaced or lost. When the leaf and main body portion are realigned, the pin may be easily slid back into place with the two portions pivoting about one another.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
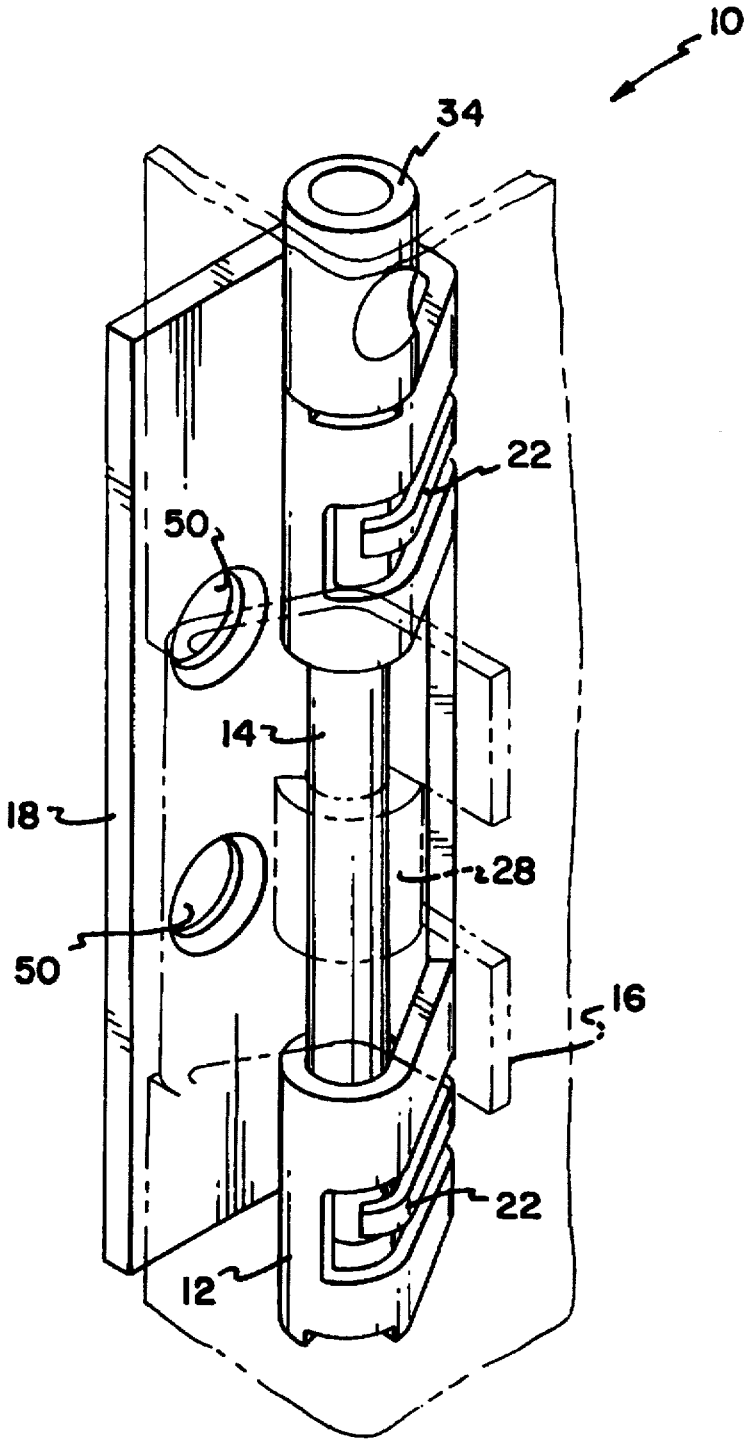
FIG. 1 shows a perspective view of a hinge according to the principles of the present invention.
Figure 4:
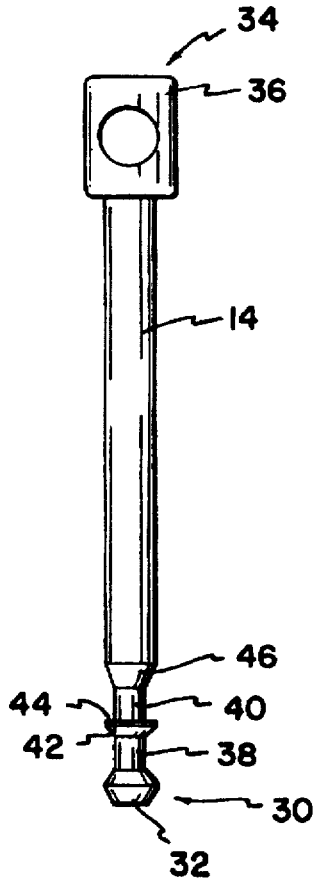
FIG. 4 shows a side elevational view of the hinge pin.
Figure 3:
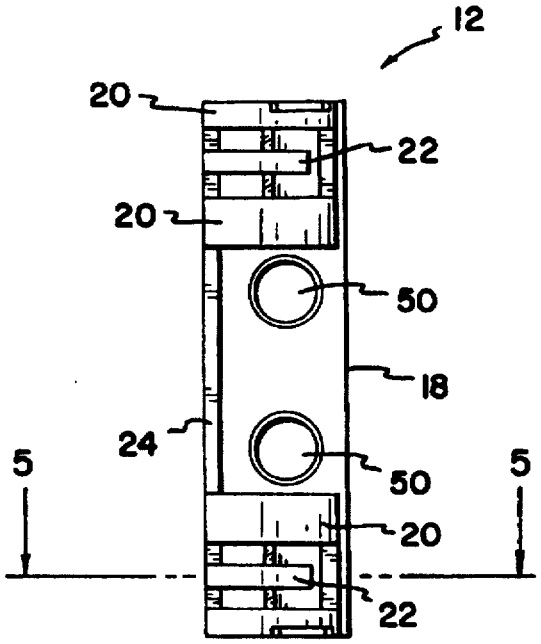
FIG. 3 shows a top plan view of the hinge body and pin shown in FIG. 1.
Figure 6:
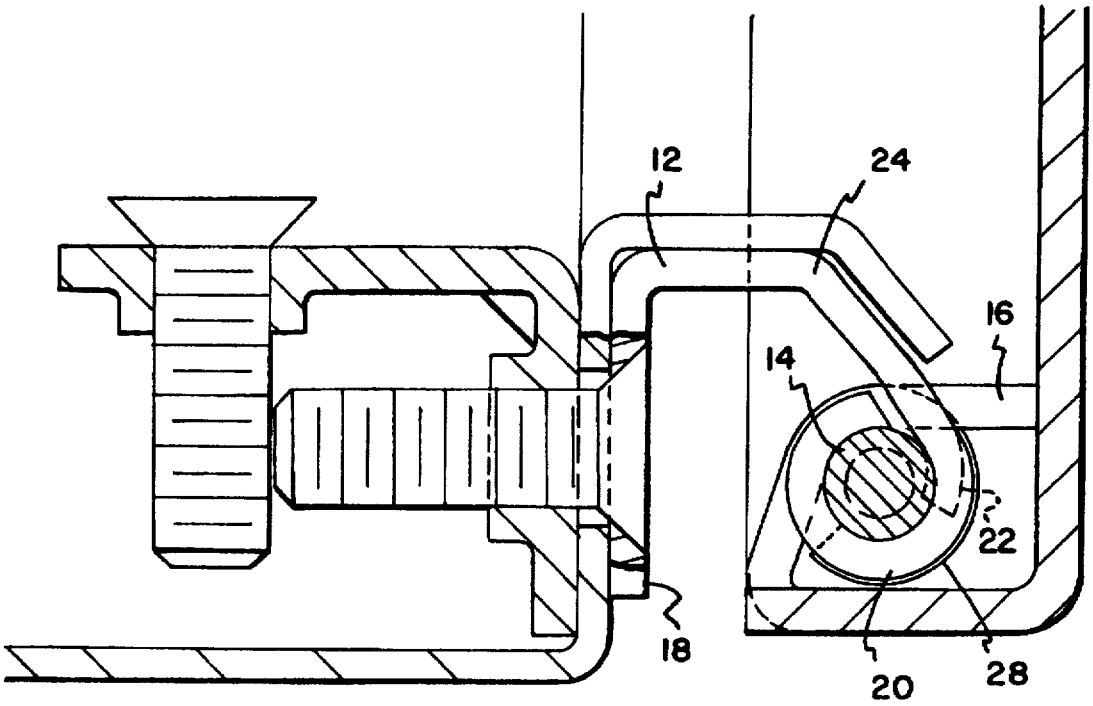
FIG. 6 shows an end view of the hinge mounting a cover to a surface.
Figure 5:
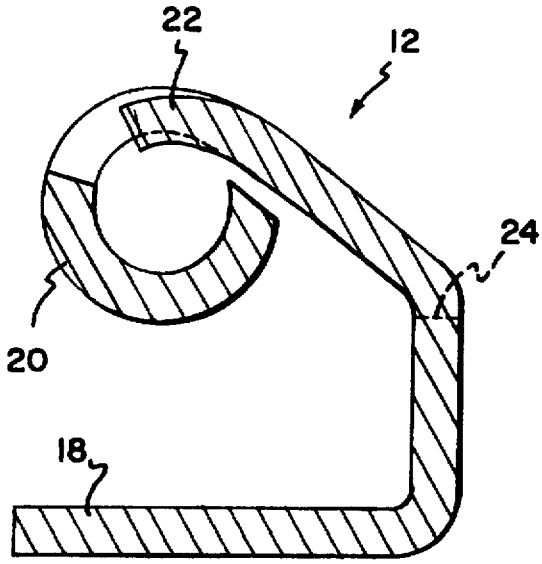
FIG. 5 shows a sectional view of the hinge taken along line 5—5 of FIG. 3.

Referring now to the drawings, wherein like reference numerals designate corresponding structure throughout the views, and referring in particular to FIG. 1, there is a shown a hinge, generally designated 10. The hinge 10 includes a main hinge body 12 pivoting with a leaf 16 about a pin 14. The components of the hinge 10 may be made of brass or other suitable materials. The hinge body 12 includes a base 18 having mounting holes 50 formed therein for mounting the hinge body 12 to a surface. A support portion 24 extends upward from the base 18 and includes annular knuckles 20 configured to receive and surround the pin 14, as explained hereinafter. The knuckles 20 each include a portion which is cut out from the annular portion of the knuckle 20 and extending into the support portion 24. A retainer member 22 is formed in the cut out portion and extends from the support portion 24 partially into the space which is enclosed by each knuckle 20, as also shown in FIG. 4. The retainer member 22 may extend on either side of the opening for the pins.

Figure 2:
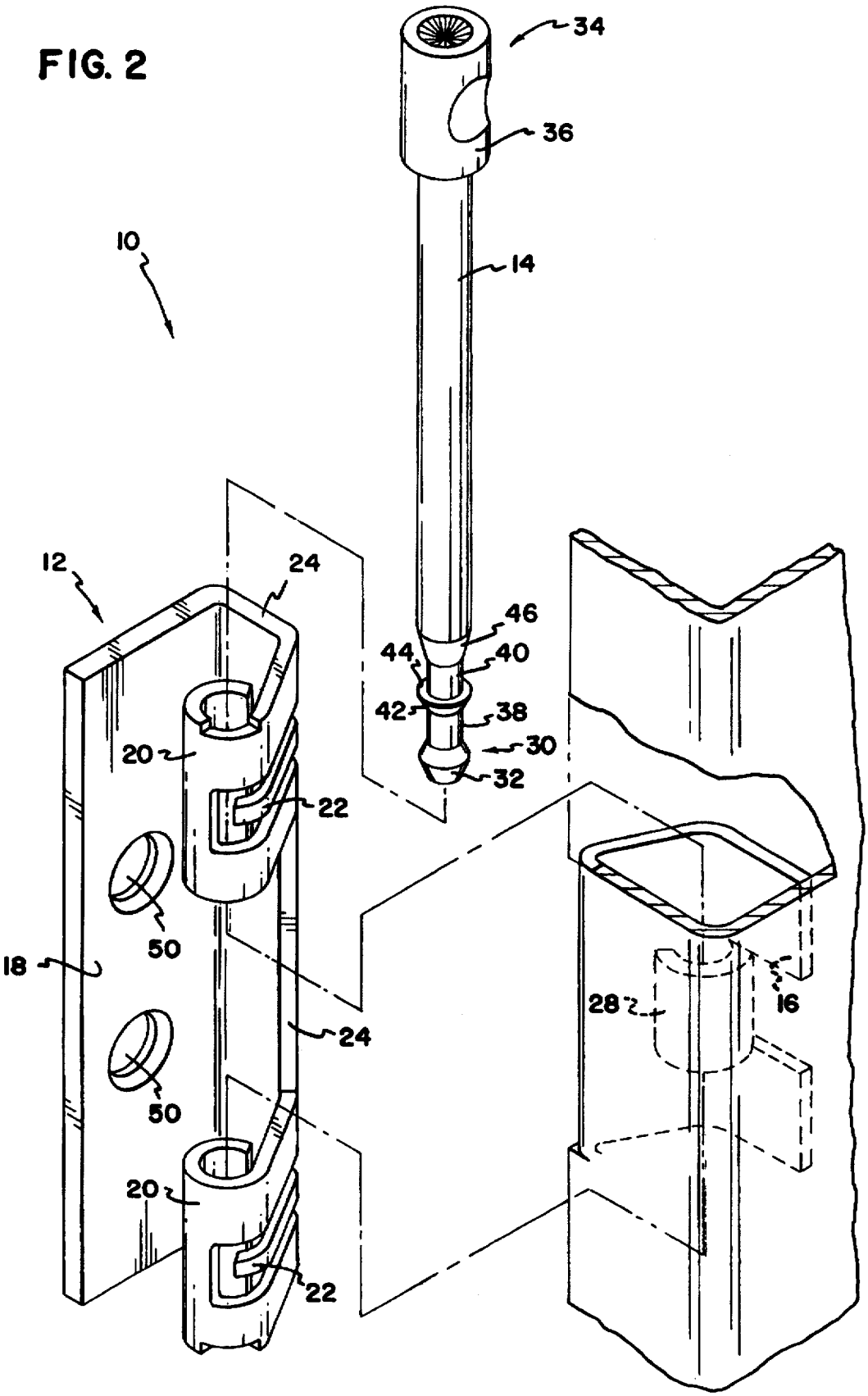
FIG. 2 shows an exploded perspective view of the hinge shown in FIG. 1.

As shown most clearly in FIG. 2, the leaf member 16 also includes a knuckle 28 and may be molded into a cover or other pivoting portion. It can be appreciated that many configurations and mounting methods for the leaf 16 may be utilized.

Referring now to FIG. 4, the pin 14 is shown. The pin 14 includes a first end 30 with a tapered nose portion 32. At a second end 34, an enlarged pin removal portion 36 is configured to be gripped or pried to aid removal of the pin 14. Proximate the first end 30 are a first annular groove 38 and a second annular groove 40. The first annular groove includes a pair of tapering sides 42. The second annular groove 40 includes a straight side 44 nearer the first end 30 and extending radially outward. A second side 46 tapers radially outward nearer the second end 34.

The hinge pin 14 inserts through the knuckles 20 and 28 to pivotally connect the hinge body portion 12 to the leaf portion 16. When the pin 14 is inserted into a first knuckle 20, the first end 30 engages the retainer member 22. The tapered portion 32 forces the retainer portion 22 outward and allows the pin to slide by. In a similar manner, the retainer member 22 slides over the first annular groove 38 and its tapered side 42. The retainer 22 then slides over the second annular groove 40, as the retainer 22 slides over the straight side 44.

As the pin 14 slides through the leaf knuckle 28, the pin 14 engages the second knuckle 20. As with the first knuckle engaged, the retainer member 22 slides over the annular groove 38. At this point, the pin 14 is fully engaged, as shown in FIG. 1. The retainer member 22 at the first end of the pin 30 rests in the annular groove 38. The pin 14 is prevented from being further inserted through the hinge body 12 as the removal portion 36 abuts the knuckle 20.

To remove the pin 14, it is retracted from the hinge body toward the second end 34. The retainer 22 is easily pushed radially outward and slides over the tapered side 42 of the annular groove 38. The pin 14 is slid further until the retainer member 22 on the knuckle 20 nearer the second end 34 of the pin is biased into the second annular groove 40. At this point the knuckle 28 is disengaged and the leaf member 16 may be separated from the hinge body member 12.

The pin 14 may not be retracted further at this point as the retainer member 22 is resting in the second annular groove 40. Further pressure forces the side of the retainer member 22 against the straight side 44 of the second annular groove 40. This prevents further retracting movement of the pin 14 relative to the retainer 14. However, as the retainer member 22 is resting in the annular groove 40, the biasing force of the member is sufficient to retain the pin 14 from sliding in either direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hinge, comprising:

(a) a hinge body, including a base and a riser portion, the riser portion extending upward from the base portion and supporting a plurality of knuckles forming an aligned tubular opening, wherein each knuckle includes a biasing portion on an upper portion thereof extending partially into the tubular opening, and wherein the biasing portion and hinge body are monolithic; and, (b) a pin configured to fit though the tubular openings including a first tapered end and a first annular groove formed in the pin proximate the tapered end, the first groove including tapered sides; and a second annular groove including a first straight side nearer the tapered end and a tapering side on an opposite side, wherein the biasing portions are configured to extend into the grooves.

2. A hinge according to claim 1, further comprising mounting means for mounting the hinge body to a surface.

3. A hinge according to claim 1, wherein the pin further comprises pin removal means for removing the pin from the hinge.

4. A hinge according to claim 3, wherein the pin removal means includes a portion having a width larger than the width of the tubular openings.

5. A hinge according to claim 1, further comprising a leaf portion including a knuckle intermediate two knuckles on the hinge body configured to receive the pin.

6. A hinge, comprising:

(a) a hinge body, including a base and a riser portion, the riser portion extending upward from the base portion and supporting a plurality of knuckles forming an aligned tubular opening, wherein each knuckle includes a biasing portion extending partially into the tubular opening, and wherein the biasing portions and the hinge body are a monolithic element; and, (b) a pin configured to fit through the tubular openings including a first annular groove formed in the pin, wherein the biasing portions are configured to extend into the first annular groove.

7. A hinge according to claim 6, wherein the pin includes a first tapered end and a second annular groove formed in the pin, and wherein the first annular groove is located nearer the first tapered end than the second annular groove and includes tapered sides, and the second annular groove includes a straight side proximate the first tapered end and a tapering opposite side.

* * * * *